United States Patent [19]

Leece

[11] Patent Number: 4,908,967

[45] Date of Patent: Mar. 20, 1990

[54] HEAVY DUTY ROCK TRENCHER

[76] Inventor: Quentin J. Leece, Coaches Inn, No. 116, Superior, Nebr. 68978

[21] Appl. No.: 285,592

[22] Filed: Dec. 16, 1988

[51] Int. Cl.[4] ..... E02F 3/14

[52] U.S. Cl. ..... 37/192 A; 37/94; 37/96; 37/191 R

[58] Field of Search ..... 37/94, 96, 191 R, 192 A, 37/86, 90; 405/175, 180; 212/238, 245; 173/39, 42, 43; 175/162, 172, 202, 203; 299/36, 82

[56] References Cited

U.S. PATENT DOCUMENTS

| | | | |
|---|---|---|---|
| 1,806,511 | 5/1931 | Vaughn | 37/90 |
| 2,783,556 | 3/1957 | Burns et al. | 37/90 |
| 2,981,012 | 4/1961 | Meyer | 37/86 |
| 3,965,628 | 6/1976 | Loftis | 173/44 X |
| 4,043,135 | 8/1977 | Hoes et al. | 37/86 X |

FOREIGN PATENT DOCUMENTS

| | | | |
|---|---|---|---|
| 815148 | 7/1979 | U.S.S.R. | 37/191 R |
| 883247 | 7/1980 | U.S.S.R. | 37/192 A |

*Primary Examiner*—Randolph A. Reese
*Assistant Examiner*—Franco S. Deliguori
*Attorney, Agent, or Firm*—Stephen D. Carver

[57] ABSTRACT

A heavy duty, chassis-mounted rock trencher for use with a conventional tractor for digging a trench, which obviates the use of outboard counterweights typically used to prevent overcentering problems. The trencher comprises an elongated digger boom selectively pivotally deployable between an inclined digging position and a roughly horizontal transport position. Additionally, the boom may be selectively contracted or extended to transfer weight overcenter and enhance stability. The boom comprises a rigid steel arm entrained by a continuous ground-engaging track of conventional digger elements journalled for rotation about cooperating sprockets upon a headshaft driven by a conventional hydraulic motor. The boom is operationally secured within a rigid, hollow, generally rectangular boom control assembly comprising a movable headshaft mounting housing and a cooperating boom mounting carriage. When the boom is contracted, the headshaft housing slides within the carriage. Hydraulic cylinders control extension, contraction, and tilt of the boom relative to the chassis. An elongated follower slot defined within the boom arm slidably receives a rigid boomshaft adapted to control torsional displacement of the boom during extension and contraction. The boom arm terminates in a pair of guide wings adapted to be slidably fitted within channels defined in the headshaft housing to substantially constrain movement of the boom during digging. Interior guide tabs and centering guides further control undesired displacement of the boom.

20 Claims, 4 Drawing Sheets

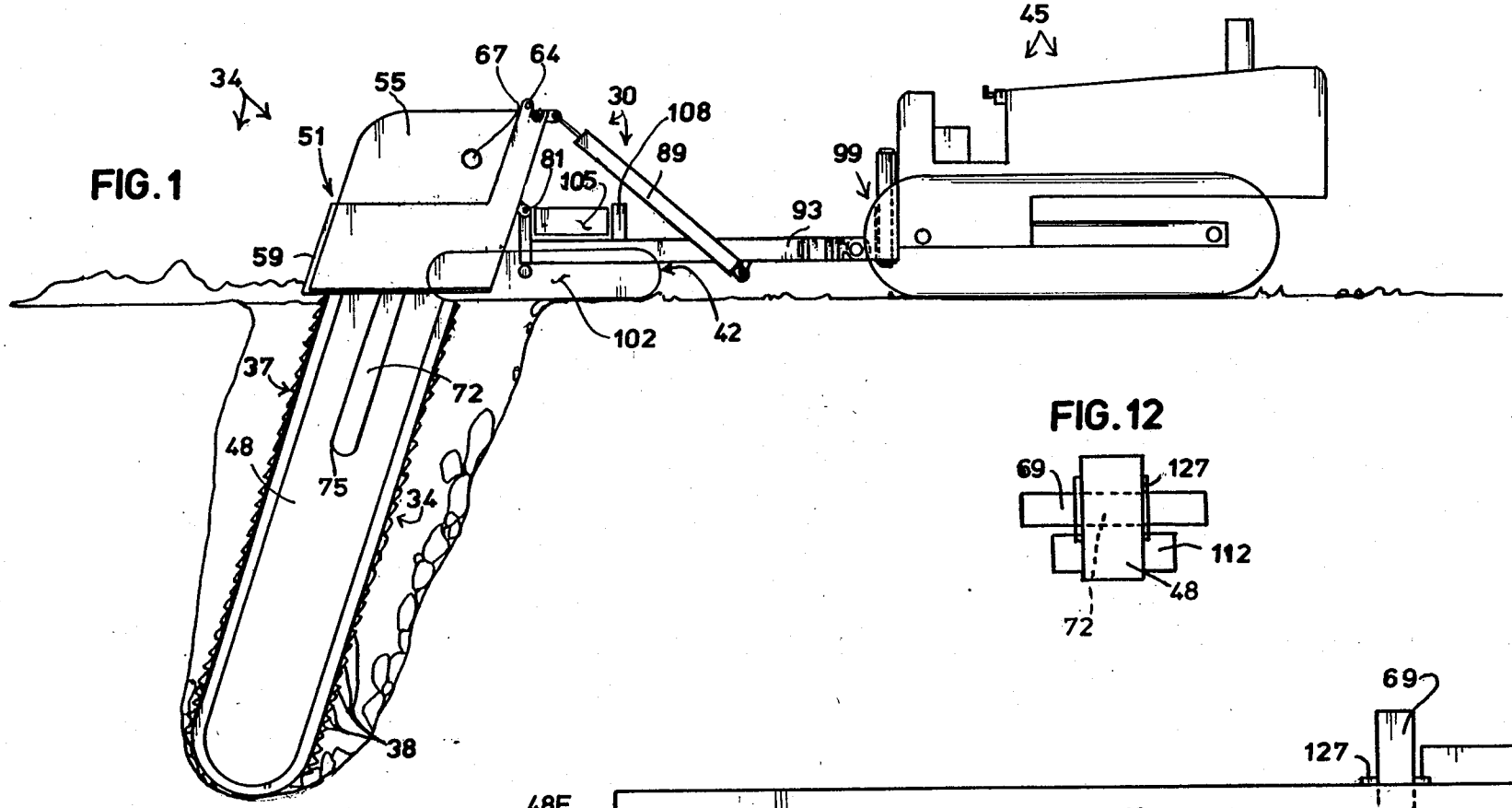
FIG. 1
FIG. 12
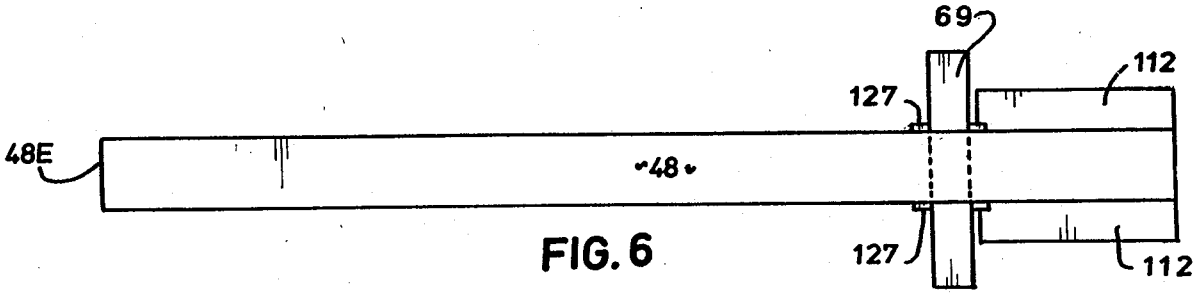
FIG. 6

HEAVY DUTY ROCK TRENCHER

BACKGROUND OF THE INVENTION

The present invention relates broadly to trench digging machines. More specifically, the present invention relates to a heavy rock trencher with a unique position-variable boom system which mechanically compensates during operation by changing the operative center of gravity.

It will be appreciated that a large number of trencher systems exist in the prior art. Typical prior art trenchers may comprise some type of tow vehicle such as a motorized cab or tractor for propulsion, but more often they comprise a single integrated motorized unit. An associated digger boom and shovel apparatus adapted to extend outwardly and downwardly from the cab operatively digs a trench at a selective depth and angle. Such booms typically comprise elongated, articulated members terminating in an enlarged shovel, or a continuous track of scoops or scrapers.

Typical of such prior art trenchers known to me are the diggers disclosed by Hovland, U.S. Pat. No. 915,963 issued Mar. 23, 1909; McIninch, U.S. Pat. No. 2,748,504, issued June 5, 1956; by Burns et al., U.S. Pat. No. 2,783,556, issued Mar. 5, 1957; and, by Ruatti in U.S. Pat. No. 1,769,074, issued July 1, 1930.

A wide variety of mechanical arrangements have been proposed to control an inclinable digger boom, including U.S. Pat. No. 1,239,474 issued Sep. 11, 1917 to French. The French '474 reference discloses the basic concept of employing an inclined ramp which is driven by an entrained chain for digging teeth. Through various mechanical linkages shown in the prior art known to me, such a chain digging assembly can be moved upwardly or downwardly, to the left or the right, or toward or away from the tractor or truck upon which it is mounted. For example, the Ruatti '074 device, although rather complex, demonstrates the broad concept of providing a variable-incline working ramp for establishing the trench incline in which the pivot point is variable with respect to the cab on which it is mounted. Petraud, U.S. Pat. No. 4,535,555, issued Aug. 20, 1985, illustrates the use of a hydraulic cylinder adapted to rotatably adjust the inclination of cooperating guide cutters. Additionally, a number of complex laser-signal systems also have been introduced to assist the operator to define the desired angle of inclination. As will be appreciated by those skilled in the operation of trenching equipment, many of the problems previously encountered with the use of early trenching devices thus have been successfully addressed in the prior art.

As a rule of thumb, successful rock trenching generally requires weight and power. One major disadvantage encountered with the operation of known conventional trenching equipment is that the tractor can easily overcenter or tilt when the boom is raised out of the ground. And, when the boom is forced downwardly, a deleterious change in the center of gravity and unwanted tilting moments can result as well. The latter problem is aggravated when the operator forces the boom against rock to be cut, creating pivoting between the boom load point and the counterweights. Typically front-mounted counterweights are employed to neutralize weight moments to prevent unwanted tilting. But such weights then interfere when the boom is forced into the ground to dig, since the then-required downward force is at least partially neutralized by the counterweights. It is well known that without regard to the size or weight of the load, the cab will overcenter and may topple if the trencher boom is forced downwardly too hard.

The heavy weight (i.e. 100 tons with counterweights included) known "fixed pivot point" equipment further aggravates stability problems. When heavier digging booms are fitted to conventional systems, more counterweights must then be added as well. None of the trenching systems known to me provides an adequate system for compensating for changes in the center of gravity of the trencher boom, without adding or removing counterweights. Moreover, no convenient method has been devised in the prior art to facilitate use of heavier or longer booms to enhance digging power where the soil is particular hard or rocky. Even when the soil is not particularly hard or rocky, multiple counterweights can interfere with mobility and operation capacity. The required counterweights also contribute to a not-insignificant transportation problem for the contractor, whose over-the-road trucking equipment must haul the machine and all the counterweights. Besides the weight problem, the apparatus must be dissembled before hauling, and then reassembled at the construction site.

Other means of preventing over-center problems include rather complex metering systems or warning devices. However, such devices typically do not improve operation of the trencher, but merely assist the operator to avoid exceeding the extension limits of the boom to prevent accidental toppling. Of course, the efficacy of such devices depends mainly upon the operator's level of skill, understanding, and attention to its operation.

Some attempts to solve the problem have been discussed in the prior art. As shown by Ealy, Pat. No. 4,255,883, issued on Mar. 17, 1981, an hydraulic cylinder may be used to move the control boom upwardly to vary the position both vertically and horizontally of the center of gravity. However, the aforementioned systems are generally overly complex and have proven ineffective in operation.

Hence it would seem desirable to provide more effective boom control means which automatically compensate for a change in the center of gravity of the trencher boom without the necessity of varying counterweights, whereby to permit the use of longer, heavier booms and to facilitate extension or contraction of the boom.

Finally, it is desirable to provide a trencher which can be easily broken down for relocation to another site. Generally, the boom must be removed and tractored separately from the tractor and trailer combination. As will be appreciated, breaking down typical prior art trenchers is very difficult and requires a great deal of additional time, resulting in additional expense to the operators. A boom system which could be quickly and conveniently broken down for transport would thus prove most advantageous and cost-effective.

SUMMARY OF THE INVENTION

The rock trencher of the present invention broadly comprises an elongated, rigid, track-driven trencher boom for forcibly digging through rock and the like during ditch or trench excavation. The system nominally requires no accessory counterweights. The boom is preferably mounted for use upon a rigid platform operatively coupled to a conventional roadworking tractor, and is provided with an assembly for selectively positioning the boom. The unique boom assembly disclosed herein permits the operator to selectively slide the boom back and forth relative to the tractor, in effect favorably changing the dynamic center of gravity during boom extension or downward forcing of the boom. The instant boom may be vigorously forced downwardly into the ground with only minimal induced rocking. The operator may selectively interchange digger booms to use booms of varying lengths and weights as required by soil conditions at a particular construction site, and his reduced dependence upon counterweights greatly aids convenience.

The preferred trencher boom comprises an elongated digger boom having a continuous track of digger elements entrained for rotation between pulleys located at opposite ends of the boom. Captured debris is conveyed transversely to a discharged position. The boom is preferably pivotally mounted upon a rigid boom tower which extends upwardly, and is linked by an hydraulic cylinder. The trencher operator may selectively position the boom between a generally vertical or inclined position for digging a ditch and a generally horizontal position for relocation. Since the boom can be linearly retracted, weight is shifted to the rear of the load point to minimize counter moments, and the requirement of outboard counterweights is greatly reduced if not obviated altogether.

The upper end of the boom is preferably enclosed within an extendible housing comprising a headshaft shroud and a cooperating boom mounting housing. A rigid, elongated boom mounting shaft associated with the boom mounting housing is slidably received within an elongated slot defined centrally within the body of the boom. The headshaft shroud and housing are operatively linked by an hydraulic cylinder. When the cylinder is extended, the headshaft housing is elevated and separated from the boom mounting housing. The headshaft housing moves out of association with the stationary boom mounting housing and retracts the boom until the boom mounting shaft contacts the opposite end of the follower slot. When the boom is fully retracted, the hydraulic cylinder which links the headshaft housing and the boom mounting housing is fully extended.

In operation, the boom may be selectively axially moved relative to its mounting point, varying the center of gravity and in effect neutralizing the otherwise destabilizing rocking forces and moments which hitherto have necessitated the use of massive outboard counterweights. Advantageous shifts in the center of gravity may be realized during use of the boom, when, for example, a heavier or longer boom is employed, or when the boom is raised from its inclined position. When it is desired, for example, to obtain a steeper incline in the ditch, the boom must be drawn closer inwardly toward the tractor. Similarly, when it is desired to relocate the assembly, the boom must be raised upwardly from an inclined position to a horizontal position.

Thus it is a broad object of the present invention to provide a boom mount system for a rock trencher which is adapted to dynamically shift the center of gravity.

Another fundamental object is to provide a boom system which obsoletes and avoids outboard counterweights.

Another object of the invention is to provide a boom which prevents or minimizes overcentering problems.

Yet another important object is to provide a boom system which can readily manipulate the center of gravity responsive to down force or shifts in the boom load in a manner advantageous to system stability and efficiency.

A similar basic object is to provide a boom which may be vigorously forced downwardly into the ground with only minimal induced rocking. It is a feature of the present invention that the boom may be tilted virtually perpendicularly to ground so as to concentrate virtually its entire weight at the point of attack without inducing rocking moments.

A still further object of the present invention is to enable an operator to conveniently, selectively interchange digger booms to use booms of varying lengths and weights as required by soil conditions at a particular construction site with reduced dependence upon counterweights.

Another broad object of the present invention is to provide a rock trencher with an improved boom mount system for preventing overcentering otherwise caused by shifts in the center of gravity.

Yet another object of the present invention is to provide a trencher which facilitates the interchanging of digger booms of greater length and weight.

A further object of the present invention is to provide a trencher boom control system which can be selectively positioned by the operator to effectuate changes in the center of gravity of the boom.

Still another broad object of the present invention is to provide a trencher of the character described which can be more quickly and conveniently dismantled for relocation than typical trenchers presently in use.

Yet another object of the present invention is to provide a rock trencher of the character described which employs conventional hydraulics for adjusting the center of gravity of the boom upon the tractor.

A further object of the present invention is to provide an improved trencher boom control system of the nature described which includes cooperating slidable housings for adjusting the position of the boom in response to a change in the center of gravity.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 1 is a pictorial view illustrating the best mode of my HEAVY DUTY ROCK TRENCHER in use with a conventional tracked vehicle for digging a trench;

FIG. 6 is a fragmentary, top plan view of the preferred boom track assembly;

FIG. 12 is a fragmentary end elevational view taken generally from a position to the right side of FIG. 6.

DETAILED DESCRIPTION

Figure 2:
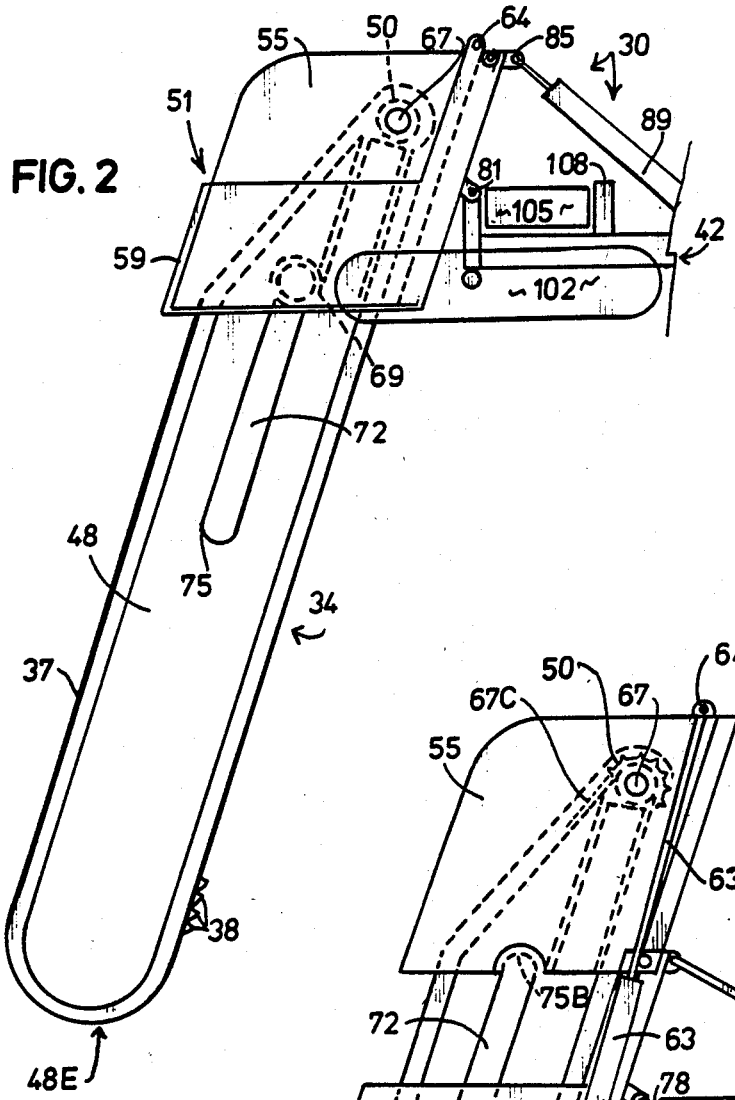
FIG. 2 is a fragmentary side elevational view illustrating the trencher boom in a typical operating orientation.

With reference to the appended drawings, the best mode of my new heavy duty rock trencher device is illustrated in FIG. 1 in use with an optional tractor for digging a trench. The trencher, broadly designated by the reference numeral 30, comprises an elongated digger boom, generally indicated by the reference numeral 34, provided with a continuous ground-engaging conveyer 37 of conventional serially arranged digger elements 38. Boom 34 may be selectively deployed in a variety of positions and configurations, and it is operationally mounted upon a rigid, platform-like frame, broadly designated by the reference numeral 42. The rigid frame is preferably supported by a pair of conventional tracked crawler assemblies forming a chassis for movement over the ground. Although illustrated operatively coupled to a tracked vehicle 45 via an optional two bar 93, any conventional heavy duty two vehicle would be suitable. Alternatively the trencher could be self propelled. The trencher is preferably hydraulically actuated, and the conventional operator controls comprising hydraulic valves and the like may be conveniently located at the rear of tractor 45. From an inspection of FIG. 1, it will be noted by those skilled in the art of trench digging that the usual outboard counterweights typically mounted upon the front of the tow vehicle for neutralizing tilting moments are absent, since the instant trencher obviates their use.

Figure 3:
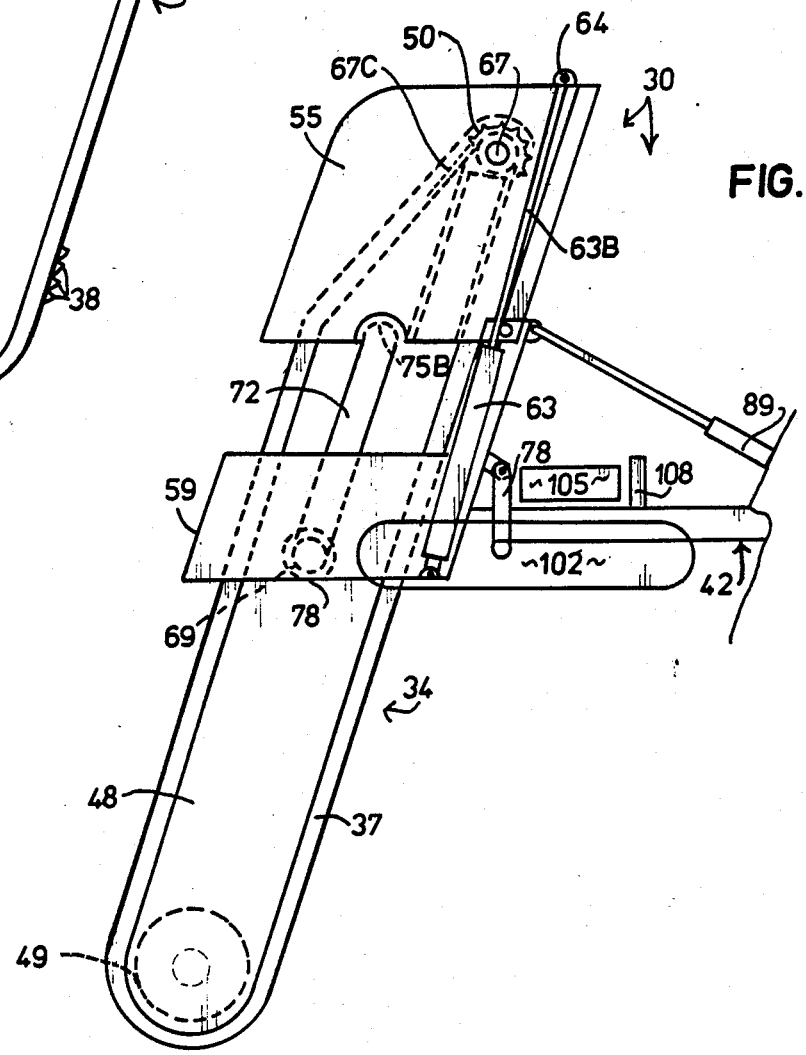
FIG. 3 is a fragmentary side elevational view similar to FIG. 2, but illustrating the boom in a vertically retracted position.

As explained in more detail below, boom control is substantially effectuated by a headshaft housing 55 and a carriage 59 which are displaceable relative to each other. For purposes of clarity herein, it should be understood that the term "contraction," as well as variations thereof, shall refer to the uniting of housing 55 and carriage 59 as in FIGS. 2 and 4. The terms "extended," or "extension" and their variations, shall refer to the position in which the housing 55 and the carriage 59 are separated and spaced apart from one another, as in FIGS. 3 and 5. It should further be realized that the boom may be vertically, horizontally, or angularly deployed in either contracted or extended orientations. Contraction in the vertical mode (FIG. 2) thus disposes the boom arm end 48E the maximum distance away from the frame, as when maximum deepness is attained. FIGS. 3 illustrates a digging orientation, while the generally horizontal boom orientation shown in FIG. 5 should be assumed for transportation and/or relocation.

When the boom 34 is selectively contracted or extended between the various positions of FIGS. 1–5, dynamic changes in the center of gravity transmitted to the load points will be realized. Downward forces can be concentrated onto the trench without "fighting" tow vehicle bending moments from counterweights. Similarly, when deployed as in FIG. 5, the boom transfers weight overcenter, and the load to be towed stabilizes since bending moments are neutralized. Hence, use of the present system permits employment of heavier and longer booms than have been traditionally employed, and facilitates breaking down the assembly for selective substitution of a different size or style of digger boom or for relocation of the trencher 30 to a different construction site.

Figure 4:
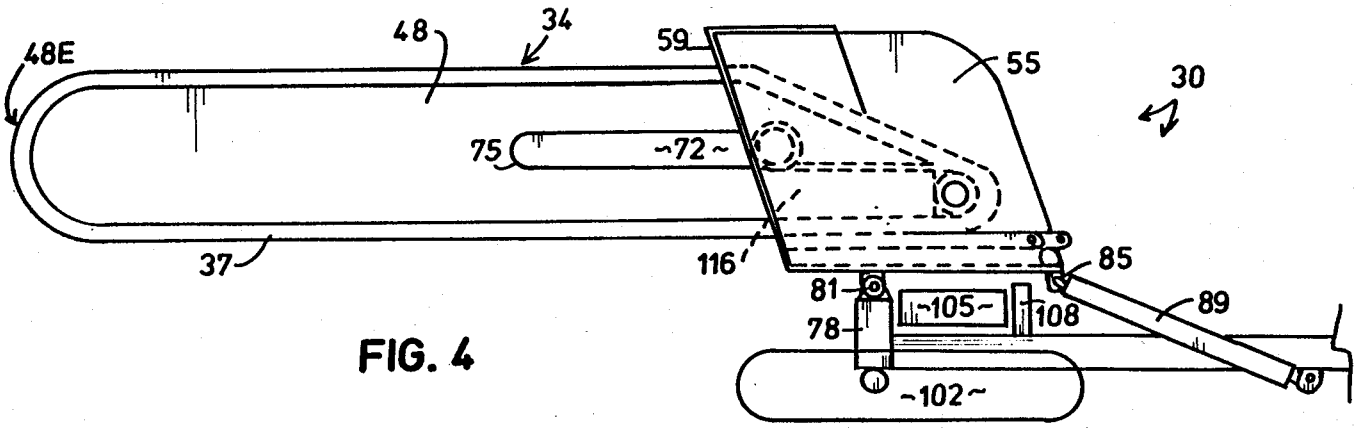
FIG. 4 is a fragmentary side elevational view illustrating the trencher boom in an elevated, substantially horizontal, retracted position.
Figure 5:
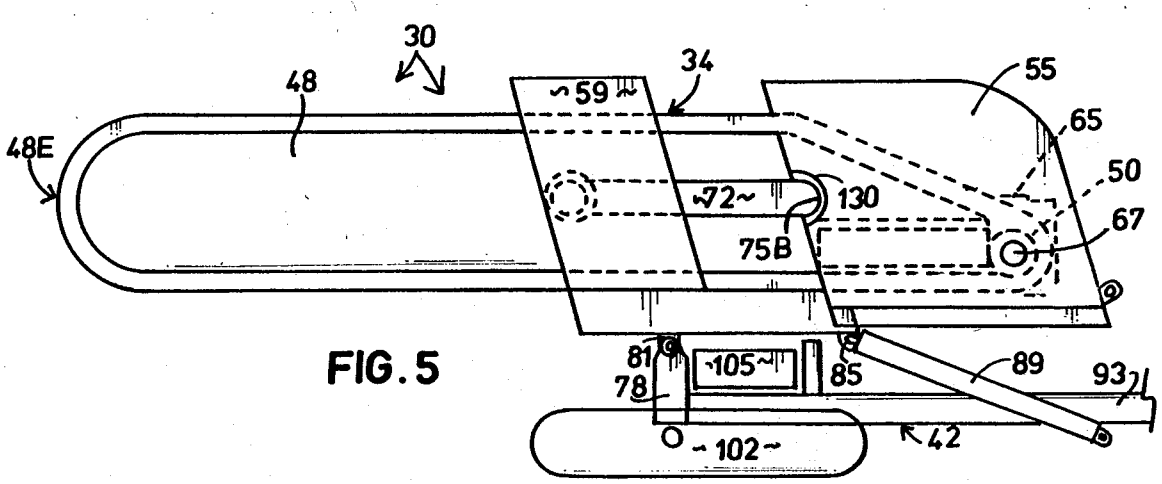
FIG. 5 is a fragmentary side elevational view similar to FIG. 4, but illustrating the trencher boom in a horizontally shifted position wherein weight has been transferred overcenter toward the rear of the assembly.

With combined reference directed now to FIGS. 2–12, boom 34 comprises a rigid, preferably heat treated, elongated steel arm 48 of generally rectangular cross section. Arm 48 supports a conventional rotatable conveyor track 37 entrained for continuous rotation to effectuate digging. The track 37 is operatively coupled over a pair of spaced-apart, cooperating split sprockets 50, positioned on the headshaft at the boom top, and it is entrained about a lower digging pulley 49 (FIG. 3) captivated within arm end 48E. The cylinder-like pulley 49 is rotatably captivated within arm 48 and unites with track 37 to form the ground-engaging attack end of the boom arm. The conventional sprockets 50 are journalled for rotation upon a headshaft 67 which, as will hereinafter be explained in detail, is rotatably secured at the boom top, projecting between opposite walls within headshaft housing 55. Headshaft 67 is driven by a conventional hydraulic motor 65, a portion of which is seen in FIG. 5. Motor actuation rotates headshaft 67 to revolve the track 37.

Boom 34 comprises a rigid, hollow, generally rectangular boom control assembly 51 comprising a movable headshaft mounting housing 55 and a cooperating boom mounting carriage 59. Carriage 59 is pivotally mounted to the chassis by coupling to frame 42, and the entire chassis is supported at each side (FIG. 11) by a pair of conventional, load-bearing tracked crawlers 102. Carriage 59 is supported by load bearing trunnions 78 (FIGS. 4, 5) to which it is removably secured by pivot pins 81, so that it may be appropriately tilted during operation, as will hereinafter be explained. Housing 55 is displaceable toward or away from carriage 59. When the boom is contracted, headshaft housing 55 is mated to carriage 59; when the boom is extended, members 55 and 59 separate. When in the position illustrated in FIG. 2, the lowermost portion of housing 55 will be substantially surrounded by and housed within carriage 59, uniting to form the composite assembly 51, which substantially shrouds internally disposed boom parts such as the drive motor and sprockets. Headshaft 67 is mounted for rotation between opposite rigid walls of the headshaft mounting housing 55, and is thus displaceable therewith. As best illustrated in FIG. 3, boom 34 is not penetrated by or fixed upon headshaft 67, and it will be appreciated that arm support is provided by the track 37. Arm 48 is entrained by and supported upon track 37 and thereby movably supported within housing 55. Thus the boom is not totally captivated, but enjoys a degree of resilient freedom for shaking and vibration within the housing. When the boom is oriented substantially vertically as in FIGS. 2 and 3, the headshaft 67 will thus support the majority of the arm's weight.

Hydraulic cylinders 63 (FIG. 3) are coupled on each side of the boom between carriage 59 and the top of the boom shaft housing 55. Thus rods 63B are terminated at pin-and-clevis mountings 64 at the boom top (FIG. 3). When cylinders 63 are activated to extend the boom, headshaft housing 55 is separated out of boom carriage 59 and maintained in spaced-apart position therefrom. Concurrently, the entire boom arm 48 and the associated digging conveyor 38 will be moved longitudinally upwardly from the configuration of FIG. 2 to that of FIG. 3.

At its upper end, boom arm 48 is positioned within headshaft housing 55. The arm will travel through the interior of carriage 59 when contractions or extensions occur. The rigid, elongated boomshaft 69 is slidably fitted through follower slot 72 of arm 48 and opposite centering collars 127 (FIGS. 6, 12) are welded to opposite boomshaft ends. These collars 127 center the shaft 69 relative to the interior of the arm 48 as the assembly is moved. Axial boom travel is limited to the dimensions of the follower slot 72 defined in the arm 48. Thus, when cylinder 63 is pressurized to pull headshaft housing 55 apart from carriage 59, boom 34 is extended and arm 48 slides relative to boomshaft 69, which at all times penetrates boom arm slot 72. The boom 34 can also be selectively extended until shaft 69 contacts the outermost end 75 of follower slot 72, as illustrated in FIG. 3. Travel is limited at the opposite end of the slot 72 by shaft contact with end 75B (FIG. 3) when the boom is contracted.

The boom assembly 34 is pivotally mounted upon and between rigid supporting boom trunnions 78 (FIGS. 4, 5), one of which is disposed on each side of the frame 42. A rigid, generally U-shaped bracket projects downwardly from each side of the lower surface of carriage 59 to be pivotally fitted iith pins 81 to the trunnions 78. The rigid, heavy duty pivot pin, bolt, or other suitable fastener 81 penetrates the brackets and trunnions 78 to semi-permanently, pivotally secure the boom. A second rigid coupling 85 (FIG. 8) associated with the opposite end of carriage 59 is adapted to link carriage 59 to an hydraulic cylinder 89 permanently, operatively secured to frame 42. As will be appreciated, cylinder 89 functions not only to secure boom 34 to frame 42, but also to limit the speed and degree of incline, and to maintain the boom in balance as it is contracted and extended during use.

Figure 7:
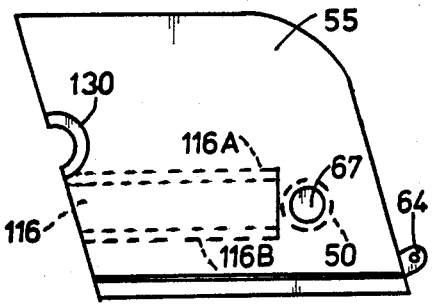
FIG. 7 is an enlarged scale, fragmentary, side elevational view illustrating portions of the preferred headshaft housing.
Figure 8:
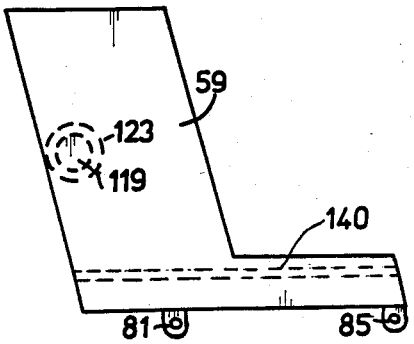
FIG. 8 is an enlarged scale, fragmentary, side elevational view illustrating portions of the preferred boom mounting carriage.

As best illustrated in FIGS. 6 and 12, boom arm 48 terminates in a pair of rigid, generally rectangular guide wings 112. Wings 112 are slidably fitted within wing-receptive channels 116 defined within headshaft housing 55 between a channel top 116A and a rigid channel bottom 116B (FIG. 7). Comparing FIGS. 6, 7 and 9, it will be seen that arm 48 will slidably fit into head shaft housing 55 during assembly, and thereafter the track 37 is assembled. Arm end 48E will be positioned immediately adjacent the pre-installed head shaft 67. Wings 112 slidably fit within channel 116 (FIG. 7), and as arm 48 moves somewhat during the violent digging operation, the arm will be substantially constrained. When headshaft housing 55 is moved toward carriage 59 for boom contraction, boom shaft 69 within "stationary" carriage 59 will be contacted by the cradle ends 130 (FIG. 7). As explained previously, cylinder 63 (FIG. 3) moves the boom headshaft housing 55 upwardly relative to the frame, and housing 55 thus moves interiorly through carriage 59.

Figure 9:
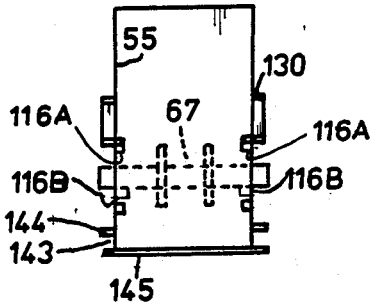
FIG. 9 is a fragmentary end elevational view taken generally from the left side of FIG. 7.
Figure 10:
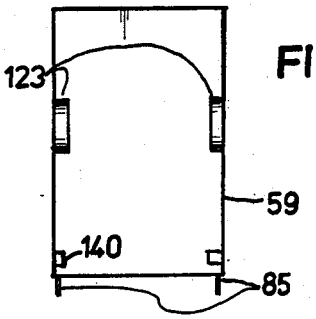
FIG. 10 is a fragmentary end elevational view taken generally from the left side of FIG. 8.

The latter movement is best explained with reference to FIGS. 7–10. Boom shaft 69 is inserted through shaft-receptive orifices 119 defined through the side walls of boom carriage 59 and braced therewithin by internal boom shaft collars 123, which will closely abut collars 127 (FIG. 6). Alignment of headshaft housing 55 as it travels through carriage 59 is maintained by registration of interior guide tabs 140 (FIGS. 8, 10) within a tracking channel 143 (FIG. 9) defined between tabs 144 and housing bottom 145 (FIG. 9). The boom centering collars guides 127 retain boom arm 48 properly centered within carriage 59. When properly assembled, the headshaft housing 55 is slidably received within boom mounting carriage 59, and boomshaft 69 comes to rest within the generally arcuate receptacle 130 defined at the forward edge of headshaft housing 55 (FIG. 7). The shaft 69 is journalled for rotation through reinforced orifice 119 established by internal collars 123 (FIG. 10).

Figure 11:
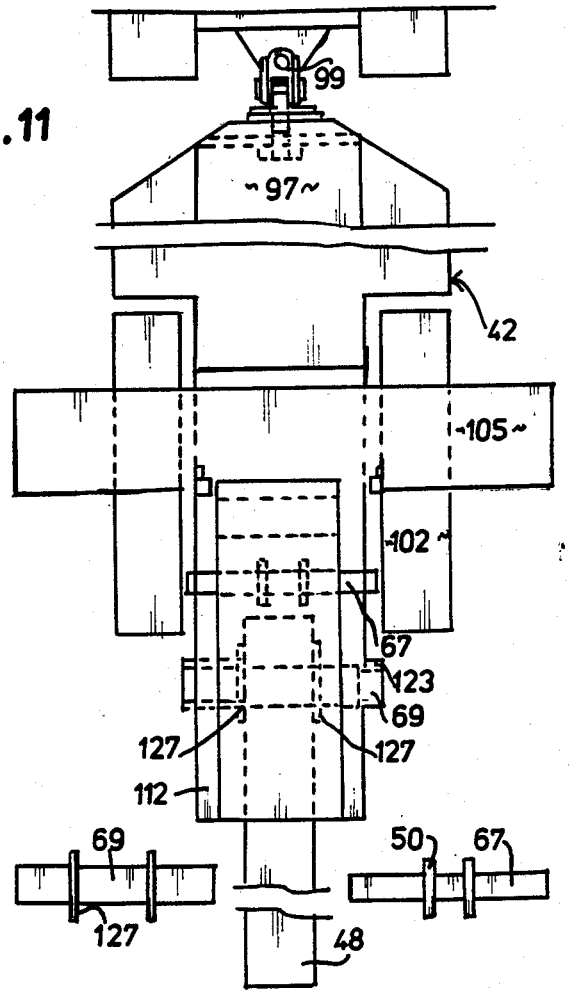
FIG. 11 is a fragmentary, top plan, exploded assembly view.

With reference now to FIGS. 1, 4 and 11, frame 42 terminates in a tapered region 97 (FIG. 11) adapted to be coupled by a conventional utility hitch system 99 to a conventional heavy duty, road-working tractor 45. A Caterpillar Model D-9 for example, or similar tracked vehicle is ideal. A conventional debris transporting conveyor system 105 is transversely frame mounted, running generally above and between the crawlers 102 (FIGS. 1, 3) to receive the debris outputted from the boom conveyer system 37. A rigid post 108 projecting upwardly from frame region 97 and functions as an auxiliary stop to prevent the boom from pivoting too far backward over the platform when it is oriented in a substantially horizontal position (FIGS. 4, 5). Thus, if the boom should suddenly release as it is elevated, stop post 108 would prevent the boom from bouncing back against the platform and damaging the conveyor system 105 or the vital hydraulics.

OPERATION

In operation the aforedescribed structure permits the trencher operator to selectively contract or extend the boom in generally horizontal or vertically inclined orientations. Boom contraction and extension affects the center of gravity and tilting moments of the combined trencher and tractor. During the majority of active digging operations the boom will be operationally vertically inclined as in FIGS. 1–3, when the weight of the boom is substantially concentrated against the ground by arm end 48E and the forward digging pulley 49. During this time the operator will be able to operate the usual hydraulic controls in a familiar manner, but he will notice that the lack of tractor mounted counterweights will make it easier to attack the point of impact during digging. For given application forces (i.e. the force of arm end 48E into the ditch) the tractor will also be noticeably more stable than known prior art arrangements, since neutralizing bending moments from counterweights will be absent.

As the arm 48 is stressed in response to inevitable impact and grinding forces, concomitant vibrations will be torsionally and horizontally restrained by the combination of boom shaft 69, which penetrates the arm follower slot 72, to permit vertically axial movements, and the arm wing structure 112 which is coupled within slot 116 of the headshaft housing 55. Additional boom resilience is effectuated by the non-rigid coupling of the arm 48 accomplished by suspending it via digging track 37 to the headshaft 67. When an unusually long boom is employed for deep trenches, when the inclined boom is drawn laterally toward the tractor to define a steeper incline in the ditch, or when an unusually heavy boom is being lifted between its inclined digging position and its horizontal position, rocking moments can be avoided by extending the boom so that weight moments are transferred to the rear of the chassis as the boom is tilted between the vertical and horizontal positions. When, for example, it is desired to elevate a long boom for relocation after the trenching operation is complete, the operator will first engage cylinder 63 to lift the headshaft housing 55 upwardly out of engagement with carriage 59 and extend the boom, as best illustrated in FIG. 3. The boom will be maintained in balance by upwardly extending cylinders 89 which tilt carriage 59, and as the boom assumes the orientation of FIG. 5, balance will be generally preserved over the pivot points at trunnions 78.

The disclosed boom system thus permits the operator to appropriately contract or extend the boom and thus redistribute weight to thereby prevent overcentering. The resultant changes in the center of gravity experienced during operation are manipulated in favor of the operator, facilitating use of longer and heavier digger booms. Use of the present system also facilitates breakdown to save time and effort normally required to interchange boom arm 48 or to move the trencher to a different construction site. When boomshaft 69 is disengaged from orifice 119, boom 48 may be quickly, slidably removed out of headshaft housing 55 after digging track 37 is disconnected. The pins 81 establishing the pivoting mounting may be removed to quick-disconnect the entire boom assembly 34 from frame 42.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A heavy duty rock trencher for digging ditches, trenches, or the like, said trencher comprising:

rigid supportive frame means adapted to be disposed upon a supporting surface for coupling said trencher to a tractor, tow vehicle or the like;

elongated boom means operatively associated with said frame means for selectively removing surface soil and debris during trenching, said boom means comprising:

a continuous digging track entrained for rotation about said boom means having a plurality of digger elements for excavating;

headshaft means for operatively revolving said track for rotation about said boom means in response to motor means;

means for controlling said boom means, said last mentioned means comprising:

headshaft housing means for revolvably mounting said headshaft means and for operatively supporting said track and thus said boom means;

carriage means coupled to said frame means for selectively guiding said boom means, said carriage means being of rigid box-like proportions and comprising a pair of sides and means pivotally coupled to said frame means to facilitate tilting of said boom means;

said headshaft housing means selectively slidably disposed relative to said carriage means for displacements toward or away therefrom, and said headshaft housing means being of rigid, generally box-like proportions and comprising a pair of spaced-apart sides between which said headshaft means is mounted for rotation;

means for tilting said carriage means to move said boom means between vertical and horizontal orientations; and, means for extending or contracting said boom means by moving said headshaft housing means relative to said carriage means, said headshaft housing means and said carriage means uniting when said boom means is contracted;

wherein said boom means may be deployed in a variety of generally vertically inclined positions or generally horizontal operating configurations, either in a contracted or extended orientation.

2. The trencher as defined in claim 1 wherein said headshaft housing means comprises tracking channel means and said carriage means comprises guide tab means adapted to be disposed in registration with said tracking channel means to facilitate alignment of said headshaft housing means and said carriage means during boom means contraction and extension.

3. The trencher as defined in claim 2 wherein said boom means comprises an elongated rigid arm adapted to be mounted within said headshaft housing means, said carriage means comprises boomshaft means extending between said carriage means sides for controlling said arm, and said arm includes an elongated follower slot adapted to be penetrated by said boomshaft to facilitate arm control.

4. The trencher as defined in claim 3 wherein said arm includes rigid wing means and said headshaft housing means comprises internally defined wing-receptive channel means adapted to receive said wing means.

5. The trencher as defined in claim 4 wherein said boomshaft means comprises collar means for abutting opposite sides of said arm to help stabilize same during boom contraction and extension.

6. The trencher as defined in claim 5, wherein said headshaft housing means is adapted to be substantially internally received within said carriage means when said boom means is contracted.

7. The trencher as defined in claim 6 wherein said headshaft housing means comprises tracking channel means and said carriage means comprises guide tab means adapted to be disposed in registration with said tracking channel means to facilitate alignment of said headshaft housing means and said carriage means during boom means contraction and extension.

8. A heavy duty trencher for selectively removing rocks, surface soil, and debris from a desired construction site to dig a ditch, trench, or the like, said trencher comprising:

chassis means for supporting said trencher upon the ground at a selected construction site, and for enabling locomotion thereof, said chassis means comprising supportive frame means which may be coupled to a tractor, tow vehicle or the like;

elongated boom means operatively associated with said chassis means for selectively removing surface soil and debris during trenching, said boom means comprising:

a continuous digging track entrained for rotation about said boom means having a plurality of digger elements for excavating; and, headshaft means for operatively revolving said track for rotation about said boom means in response to motor means;

means for controlling said boom means, said last mentioned means comprising:

headshaft housing means for revolvably mounting said headshaft means and for operatively supporting said track and thus aid boom means, said headshaft housing means comprising a pair of spaced-apart sides between which said headshaft means is mounted for rotation;

carriage means coupled to said frame means for selectively guiding said boom means, said carriage means comprising a pair of sides and a bottom pivotally coupled to said frame means to facilitate tilting of said boom means;

said headshaft housing means selectively slidably disposed relative to said carriage means and adapted to be united with said carriage means when said boom means is contracted; and, means for tilting said carriage means to move said boom between vertical and horizontal orientations; and, means for extending or contracting said boom means by moving said headshaft housing means relative to said carriage means;

wherein said boom may be deployed in a variety of generally vertically inclined positions or generally horizontal operating configurations, either in a contracted or extended orientation.

9. The trencher as defined in claim 8 wherein said headshaft housing means comprises tracking channel means and said carriage means comprises guide tab means adapted to be disposed in registration with said tracking channel means to facilitate alignment of said headshaft housing means and said carriage means during boom means contraction and extension.

10. The trencher as defined in claim 9 wherein said boom means comprises an elongated rigid arm adapted to be mounted within said headshaft housing, said carriage means comprises boomshaft means extending between its sides for controlling said arm, and said arm includes an elongated follower slot adapted to be penetrated by said boomshaft to facilitate arm control.

11. The trencher as defined in claim 10 wherein said arm includes rigid wing means and said headshaft housing means comprises internally defined wing-receptive channel means adapted to receive said wing means.

12. The trencher as defined in claim 11 wherein said boomshaft means comprises collar means for abutting opposite sides of said arm to help stabilize same during boom contraction and extension.

13. The trencher as defined in claim 12 wherein said headshaft housing means comprises tracking channel means and said carriage means comprises guide tab means adapted to be disposed in registration with said tracking channel means to facilitate alignment of said headshaft housing means and said carriage means during boom means contraction and extension.

14. A heavy duty trencher adapted for selectively removing rocks, surface soil, and debris from a desired construction site to dig a ditch, trench, or the like, said trencher comprising:

chassis means for supporting said trencher upon the ground at a selected construction site, and for enabling locomotion thereof, said chassis means comprising supportive frame means for coupling said trencher to a tractor, tow vehicle or the like;

elongated boom means operatively associated with said chassis means for selectively removing surface soil and debris during trenching, said boom means comprising:

an elongated rigid arm;

a continuous digging track entrained for rotation about said arm and having a plurality of digger elements; and, an elongated follower slot;

means for controlling said boom means, said last mentioned means comprising:

headshaft means for operatively revolving said track for rotation about said arm in response to motor means;

headshaft housing means for revolvably mounting said headshaft means and for operatively supporting said track and thus said arm, said headshaft housing means comprising a pair of spaced-apart sides between which said headshaft means is mounted for rotation;

carriage means coupled to said frame means for selectively guiding said boom means, said carriage means comprising a pair of sides and a bottom pivotally coupled to said chassis means to facilitate tilting of said boom means;

boomshaft means journalled between the sides of said carriage means and passing through said follower slot in said arm;

said headshaft housing means selectively slidably disposed relative to said carriage means and adapted to be substantially united with said carriage means when said boom means is contracted, said headshaft housing means comprising tracking channel means and said carriage means comprising guide means adapted to be disposed in registration with said tracking channel means to facilitate alignment of said headshaft housing means and said carriage means during contraction or extension;

first hydraulic means for tilting said carriage means to move said boom means between vertical and horizontal orientations; and, second hydraulic means for extending or contracting said boom means by moving said headshaft housing means relative to said carriage means;

wherein said boom means may be deployed in a variety of generally vertically inclined positions or generally horizontal operating configurations, either in a contractor or extended orientation.

15. The trencher as defined in claim 14 wherein said arm includes rigid wing means and said headshaft housing means comprises internally defined wing-receptive channel means adapted to receive said wing means.

16. The trencher as defined in claim 15 wherein said boomshaft means comprises collar means for abutting opposite sides of said arm to help stabilize same during boom contraction and extension.

17. The trencher as defined in claim 16 wherein said headshaft housing means comprises tracking channel, means and said carriage means comprises guide tab means adapted to be disposed in registration with said tracking channel means to facilitate alignment of said headshaft housing means and said carriage means during boom means contraction and extension.

18. A heavy duty rock trencher for digging ditches, trenches, or the like, said trencher comprising:

rigid supportive frame means adapted to be disposed upon a supporting surface;

elongated boom means operatively associated with said frame means for selectively removing surface soil and debris during trenching, said boom means comprising a continuous digging track entrained for rotation about said boom means and comprising a plurality of digger elements for excavating;

headshaft means for driving said track;

headshaft housing means for revolvably mounting said headshaft means and for operatively supporting said track and thus said boom means;

carriage means coupled to said frame means for selectively guiding said boom means, said carriage means being of rigid box-like proportions and comprising a pair of sides and means pivotally coupled to said frame means to facilitate tilting of said boom means;

said headshaft housing means selectively slidably disposed relative to said carriage means for displacements toward or away therefrom, and said headshaft housing means being of rigid, generally box-like proportions including a pair of spaced-apart sides between which said headshaft means is mounted for rotation;

means for tilting said carriage means to move said boom means between vertical and horizontal orientations; and, means for extending or contracting said boom means by moving said headshaft housing means relative to said carriage means, said headshaft housing means and said carriage means uniting when said boom means is contracted;

wherein said boom means may be deployed in a variety of generally vertically inclined positions or generally horizontal operating configurations, either in a contracted or extended orientation.

19. The trencher as defined in claim 18 wherein said headshaft housing means comprises tracking channel means and said carriage means comprises guide tab means adapated to be disposed in registration with said tracking channel means to facilitate alignment of said headshaft housing means and said carriage means during boom means contraction and extension.

20. The trencher as defined in claim 19 wherein said boom means comprises an elongated rigid arm adapted to be mounted within said headshaft housing means, said carriage means comprises boomshaft means extending between said carriage means sides for controlling said arm, and said arm includes a elongated follower slot adapted to be penetrated by said boom shaft to facilitate arm control.

* * * * *